US010265751B2

(12) United States Patent
Flehmig

(10) Patent No.: US 10,265,751 B2
(45) Date of Patent: Apr. 23, 2019

(54) METHOD AND DEVICE FOR ACHIEVING LONG COLLAR LENGTHS

(71) Applicants: ThyssenKrupp Steel Europe AG, Duisburg (DE); ThyssenKrupp AG, Essen (DE)

(72) Inventor: Thomas Flehmig, Ratingen (DE)

(73) Assignees: thyssenkrupp Steel Europe AG, Duisburg (DE); thyssenkrupp AG, Essen (DE)

( * ) Notice: Subject to any disclaimer, the term of this patent is extended or adjusted under 35 U.S.C. 154(b) by 159 days.

(21) Appl. No.: 15/171,756

(22) Filed: Jun. 2, 2016

(65) Prior Publication Data

US 2016/0354824 A1 Dec. 8, 2016

(30) Foreign Application Priority Data

Jun. 3, 2015 (DE) ..... 10 2015 108 768

(51) Int. Cl.

| | |
|---|---|
| ***B21D 19/08*** | (2006.01) |
| ***B21D 22/22*** | (2006.01) |
| ***B21D 24/04*** | (2006.01) |
| ***B21D 28/24*** | (2006.01) |
| *B21D 22/20* | (2006.01) |
| *B21D 35/00* | (2006.01) |

(52) U.S. Cl.

CPC ..... *B21D 19/088* (2013.01); *B21D 22/22* (2013.01); *B21D 24/04* (2013.01); *B21D 28/24* (2013.01); *B21D 22/201* (2013.01); *B21D 35/001* (2013.01)

(58) Field of Classification Search

CPC ..... B21D 19/08; B21D 19/088; B21D 22/06; B21D 22/22; B21D 28/343; B21D 35/001

See application file for complete search history.

(56) References Cited

U.S. PATENT DOCUMENTS

| | | | | |
|---|---|---|---|---|
| 1,613,961 A | | 1/1927 | Schwartz | |
| 4,956,989 A | * | 9/1990 | Nakajima | B21D 22/04 72/327 |
| 6,457,340 B1 | * | 10/2002 | Kanemitsu | B21D 53/26 72/335 |

FOREIGN PATENT DOCUMENTS

| | | |
|---|---|---|
| DE | 1 452 669 A | 3/1969 |
| DE | 2754563 A | 6/1978 |
| DE | 100 20 176 A | 11/2001 |

(Continued)

OTHER PUBLICATIONS

English language machine translation of DE 10 2011 117 066 A1.
English language machine translation of DE 10 2006 029 124 A1.

*Primary Examiner* — Debra M Sullivan
(74) *Attorney, Agent, or Firm* — RMCK Law Group PLC

(57) ABSTRACT

Quality collars with long collar lengths, homogeneous wall thickness distributions, and high loadability even in high-strength materials such as steel can be achieved on workpieces according to the disclosed methods and devices. One example method involves drawing the workpiece such that the drawn workpiece has a flange region and a drawn region adjoining the flange region, wherein the drawn region has a wall region and a drawn base adjoining the wall region, with the wall region forming a part of the collar; punching the drawn base located in the drawn region of the workpiece such that a drawn-base subregion adjoins the wall region; expanding the drawn-base subregion such that the expanded drawn-base subregion forms a part of the collar; and at least partially ironing and/or expanding the collar.

10 Claims, 11 Drawing Sheets

(56) References Cited

FOREIGN PATENT DOCUMENTS

| | | | |
|---|---|---|---|
| DE | 10 2006 029 124 | A1 | 12/2007 |
| DE | 10 2011 117 066 | A1 | 5/2013 |
| EP | 2186580 | A | 5/2010 |
| GB | 1162388 | | 8/1969 |

* cited by examiner

METHOD AND DEVICE FOR ACHIEVING LONG COLLAR LENGTHS

CROSS REFERENCE TO RELATED APPLICATION

This application is a non-provisional application claiming priority to German Patent Application No. 10 2015 108 768.5, filed Jun. 3, 2015 and entitled "Verfahren und Vorrichtung zur Erzielung von groβen Kragenlängen," or, in English, "Method and Device for Achieving Long Collar Lengths," which is hereby incorporated by reference in its entirety.

FIELD OF THE DISCLOSURE

The present disclosure relates to methods and devices for producing collars on workpieces.

BACKGROUND OF RELATED ART

Collars or necks are required on workpieces such as, for instance, plates or other prefabricated components for various purposes as, for example, guide members, liners, stiffening members, or threaded members. The collar required for these purposes is produced on the workpiece, in many cases by means of a forming method known as collar forming or neck forming.

When an exact form of the collar, for instance, its length or its diameter, is important, first of all the workpiece can be punched, for example. Subsequently, the previously produced hole can be widened by means of a partially conical, pointed or rounded collar punch, wherein a collar is generally formed perpendicularly to the workpiece. The degree of expansion can in this case be made dependent on the collar length to be achieved and/or on the expansion size to be achieved.

In the event that the collar length and/or the edges of the collar do not have to satisfy any particular quality demands, it is alternatively a known practice to shape the collar without previously punching the workpiece, for instance by means of flow drilling or extrusion. In the case of flow drilling, it is possible to increase the length of the collar on account of local massive forming and of the associated material store and incremental forming, although the shape accuracy and precision of neck forming sometimes suffer as a result.

However, when the collar is produced without local massive forming, it should be noted that the widening of material represents a considerable load for the particular material, since in particular the edge regions are stretched to an extreme extent. If the stretching capacity of the material is exceeded in the process, either marginal stretches with reduced possible applications or material failure occur locally, and the workpiece ruptures or tears in the region of the collar.

Thus, the hole expansion capability is dependent not only on the initial hole dimension or the hole dimension to be achieved, but also on the material itself, this setting limits to the achievable collar size and/or collar length. Thus, for instance, soft, deep-drawable steels have a good hole expansion capability. In a corresponding manner, the hole expansion capability of high-strength steels is lower, with the result that in particular the collar lengths that are achievable with these materials can be greatly limited.

However, in order nevertheless to increase the achievable collar length, it is a known practice from U.S. Pat. No. 1,613,961, for example, to initially form a hole or an opening in a planar metal sheet to avoid cracks in the production of necks. Subsequently, the metal sheet is inserted into a tool and the opening in the punched, planar sheet is widened by means of a conical punch and a collar is shaped. In that case, there should be sufficient material around the hole to shape the collar with the desired length.

German Patent Publication No. DE102006029124A1 likewise discloses a method and a device for forming necks from metal sheets using a punch and a counterholder, wherein the shaping height of the neck forming collar is intended to be achieved reliably. In that case, a planar metal sheet provided with a hole is inserted into a device and a collar is shaped there by means of a punch and a die. An improvement in reliability is intended to be achieved in that a counterholder is formed in an articulated manner, in order to be able to fit closely against the metal sheet better.

However, the above approaches do not allow the shaping of collars, in particular with regard to the length thereof, to a satisfactory extent and/or implementation of such approaches is comparatively complicated, for example, as a result of the use of hydroforming. Therefore, a need persists for increased collar lengths even with high-strength and other metals, or high-strength steels, but without the need to resort to relatively complicated methods such as hydroforming.

It is conceivable initially to provide a deep-drawing method, a subsequent punching operation, and subsequent expanding in a combination tool. However, it is a problem that sharp cutting edges that are required for punching can cause severe notching of the material during deep drawing when use is made for example of a combination tool. Notching can reduce the quality of the subsequent collar wall and/or does not allow the required drawing depth to be achieved.

It would likewise be conceivable in theory to provide a rounded base of the drawing punch. However, this approach would result in less material being able to flow out of the flange region and into the wall region, and this would reduce the drawing depth and collar depth.

In the particular case of an unfavorable drawing ratio, such as when the original workpiece diameter or the flange region is large compared to the diameter of the deep-drawn region, for example, there continues to be the need to increase the achievable collar length without the base region thinning out and base cracks occurring. In this regard, it would be conceivable for additional material reserves to be created in the workpiece in order to draw more material into the wall region during deep drawing, and this could indeed increase the collar length.

Yet one problem with the prior approaches is that the collar does not have a homogeneous workpiece thickness distribution as a result of the combined forming operations, because the collar has thinned-out regions at various points, for example in the region of the material reserves in the region of the punching and in the region of the expanded punching.

However, because the collars serve as, for example, liners for receiving movable axles or shafts, as described initially, they have reduced bearing surfaces as a result of the inhomogeneous sheet thickness distribution and accordingly cannot function correctly. Rather, clearance-type conditions would be required. Likewise, the inhomogeneity of the thickness distribution of the workpiece would result in different collar lengths arising, which in turn requires downstream trimming operations.

DETAILED DESCRIPTION

Figure 1:
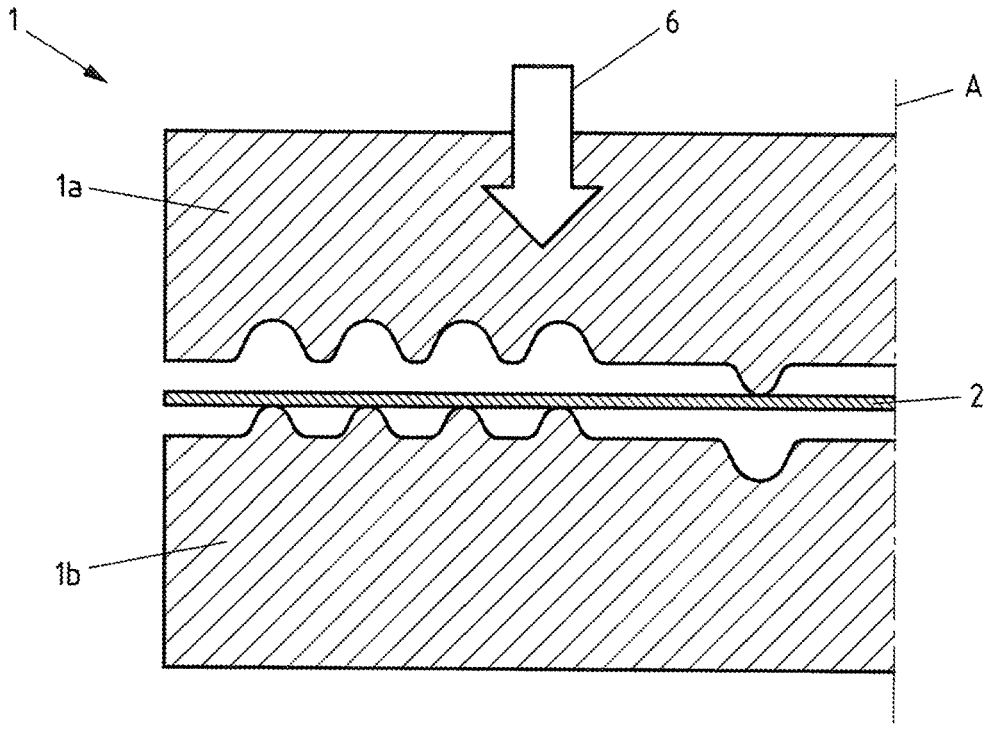
FIG. 1 is a schematic view of an exemplary embodiment of a first tool or tool portion of a device before the formation of a material reserve.

The following description of example methods and apparatus is not intended to limit the scope of the present disclosure to the precise form or forms detailed herein. Instead, the following description is intended to be illustrative so that others may follow its teachings.

One example object of the present disclosure is to provide methods and devices for producing collars on workpieces. Long collar lengths can be achieved with good quality, in particular, with a homogeneous wall thickness distribution and high strength, even in high-strength metals such as, for instance, high-strength steels.

In some examples, a method for achieving the above-identified objective comprises the steps of:

- drawing a workpiece such that the drawn workpiece has a flange region and a drawn region, adjoining the flange region, having a wall region and having a drawn base adjoining the wall region, and the wall region forms a part of the collar;
- punching the drawn base located in the drawn region of the workpiece, such that a drawn-base subregion adjoins the wall region;
- expanding the drawn-base subregion such that the expanded drawn-base subregion forms a part of the collar; and
- at least regionally ironing and/or expanding the collar.

It has been shown that during collar forming or neck forming, it is advantageous to use the wall region produced by the at least one drawing operation, in combination with a widened drawn-base subregion, to shape longer and precise collars as required, since both the wall region and the widened drawn-base subregion form at least a part of the collar. For example, in some cases, the collar comprises the entire wall region and the entire widened drawn-base subregion. It is particularly advantageous that the example methods here can be implemented easily in existing press-supported method steps, since in particular the drawing and the expansion can be realized by a drawing punch.

Furthermore, it has been shown that, as a result of at least regional ironing of the neck, a homogeneous wall thickness can be achieved for example at a desired wall thickness dimension of the collar. At the same time, strain hardening of the material of the collar can be achieved by way of the ironing. This results in an overall greater loadability of the collar, thereby allowing a reduced dimensional tolerance of the collar. Alternatively or in addition, a diameter can be increased with respect to that of the expanded drawn-base subregion at least by regional expanding of the collar. This is advantageous in particular when the collar is used as a component such as a liner, guide member, or the like, since in this case clearance-type conditions are required. Likewise, further material can flow or be drawn out of the flange region into the wall region by way of the ironing and/or expanding. This can be achieved in particular by ironing and/or expanding in the region of the collar root, that is to say in that region of the collar that adjoins the flange region. This can firstly result in an increased collar length. Secondly, the wall thickness can be increased as a result in particular in the region of the collar root. As a result, strain hardening is achieved in particular at the collar root during ironing and/or expanding, which is advantageous overall for the loadability of the collar.

At least regional ironing of the collar is understood as meaning that at least a part of the wall region as part of the collar and/or at least a part of the expanded drawn base as part of the collar is ironed. In this case, the ironing of the collar does not necessarily have to take place after the collar has been completely formed. Rather, the ironing of the collar can also take place at the same time as one or more of the other steps or (at least partially) overlap in time. In addition or alternatively, at least regional expanding of the collar can also take place. In some examples, the ironing and/or expanding of the collar to begins before the collar has been completely formed. For example, the ironing and/or expanding of the collar can overlap in time with the expanding of the drawn-base subregion. It is likewise conceivable for the ironing and/or expanding of the collar to overlap in time with the drawing of the workpiece and/or the punching of the drawn base. However, in some examples, the ironing and/or expanding begins with or after the punching of the drawn base. To this extent, the ironing and/or expanding of the collar can be understood as being inline ironing/expanding, which takes place for example in an integrated process with the formation of the collar.

For example, as a result of the drawing of the workpiece and as a result of the expanding of the drawn-base subregion, the collar is first of all expanded to a pre-expansion width that is less than the final expansion width. And as a result of the at least regional ironing and/or expanding, the collar is expanded to a final expansion width that is greater than the pre-expansion width.

In some examples, the workpiece comprises metal and, in many cases, steel. Both soft, deep-drawable steels and higher-strength or high-strength steels may be suitable for use as the steel. Moreover, the workpiece can be, for example, a substantially planar, in particular unperforated plate, a metal sheet, a semifinished product, or a virtually fully-formed component. By way of one example method, a collar can be integrally formed directly on a plate in a very efficient manner. A drawing step of some example methods may then be, for instance, a one-step drawing operation.

However, the workpiece can also be a fully formed, for example, a drawn workpiece or a prefabricated part. The drawing can then be carried out in a multistep manner, for example, in different tools to further increase the collar length or to carry out the individual method steps flexibly. A drawing step of some example methods may then represent, for instance, the final drawing step of a multistep drawing operation (for example deep drawing).

The example methods disclosed herein can be, for example, part of a cold forming operation or part of a hot forming operation, or they may be integrated into such an operation. For example, the drawing, the punching, the expanding, and/or the ironing can take place as a hot forming operation or a cold forming operation.

To increase the reliability and quality of collars, the width of the drawn-base subregion in the radial direction, that is to say in particular transversely to the drawing direction, may in some cases correspond at most to the maximum expansion width of the material.

The drawing can take place, for example, by way of a drawing punch and a die adapted thereto. The die may have, for example, a neck forming contour in which the wall region can be formed, with the result being that the drawing can be carried out reliably during neck forming. The punching may take place in some examples by way of a cutting punch. In some examples, a combined punch may be used for drawing/cutting/ironing/expanding, and the combined punch may have a cutting edge, in some cases, a rounded cutting edge, on the drawing punch base, such that punching can also be carried out with this punch. The expanding may also be carried out by way of the drawing punch. The drawing punch can likewise be used for the ironing and/or expanding of the collar. As a result, some particularly efficient methods are provided that can carry out method steps by way of only one axial punch movement, for instance, by way of lowering.

For example, the ironing and/or expanding of the collar may take place from the flange region or from the collar root in a direction of a collar end, that is, in the drawing direction.

In some examples, substantially the entire collar may be ironed and/or expanded. In other words, substantially both the entire wall region and the entire expanded drawn-base subregion may be ironed and/or further expanded. As a result, a homogeneous wall thickness of the collar can be achieved substantially along the entire collar length. In addition, strain hardening of the material of the collar can be achieved substantially along the entire collar length, which has a positive effect on the dimensional stability and loadability of the collar.

Depending on the example method being employed, the ironing and/or expanding of the collar may begin before, at the same time as, or after the punching of the drawn base. If the ironing and/or expanding begins before the punching of the drawn base, the ironing can be moved forward in time and the cycle time can be shortened. If the ironing and/or expanding begins at the same time as or after punching, the drawing of the workpiece and the punching of the drawn base and the associated material flows can be concluded first. Thus, the ironing and/or expanding can be carried out reliably.

According to another example method, the collar may be ironed and/or expanded to a substantially homogeneous wall thickness of the collar, wherein the ironed wall thickness may correspond at least to the smallest wall thickness, prior to ironing, of that region of the collar that is to be ironed. As a result of ironing and/or expanding to a substantially homogeneous wall thickness, a collar having a uniform wall thickness can be provided. This may be advantageous in particular when the collar is used as a liner, guide member, stiffening member, threaded member, or the like, since in this case clearance-type conditions are required. In addition, uniform strain hardening and thus uniform loadability properties can be achieved in the ironed region, such that the collar as a whole can take more loading. This may apply in particular when the wall thickness of the collar is ironed and/or expanded to a wall thickness which corresponds, before ironing, at least to the smallest wall thickness of that region of the collar (for example the entire collar) that is to be ironed. In this regard, ironing and/or expanding to a substantially homogeneous wall thickness can be understood as being planing.

Some example methods may additionally comprise:

upsetting the collar at least regionally, preferably after the expanding of the drawn-base subregion.

As a result of the upsetting of the collar, local length differences of the collar as seen in the drawing direction can advantageously be reduced or avoided. In addition, as a result of the upsetting of the collar, further strain hardening can be introduced into the collar in addition to the strain hardening introduced by the ironing and/or expanding, this further increasing the loadability. The collar may be upset, for example, around its entire circumference. The collar end may be upset, for example, to a uniform length, with the result being that, for instance, trimming operations by way of separate steps can be saved on, thereby shortening the cycle times. The upsetting can advantageously be integrated into the method as inline upsetting. For example, it can overlap or coincide in time with the ironing and/or expanding of the collar. For example, the upsetting of the collar follows the expanding of the drawn-base subregion. Although shortening of the collar length, for example, by the length difference of the collar as seen in the drawing direction, can arise as a result of the upsetting, this shortening can be at least partially compensated by the ironing and/or expanding of the collar.

Some example methods may additionally comprise:

integrally forming a defined geometry, in particular a stamped portion, in the inner flange region of the workpiece, preferably at the end of the ironing and/or expanding operation.

As a result, the drawing radius, that is, the radius of the flange region, can be reduced, for instance, to a required minimum, such that collars having comparatively small drawing radii can be provided. In addition, as a result of the integral forming of a defined geometry, precise positioning of the collar for further steps can be made easier. For example, the positioning of the collar by way of a reference positioning system (RPS) is improved as a result. For instance, the defined geometry may be a stamped portion. This may be understood as being a step geometry with a defined shape. For example, a regional lowering of the flange region may be achieved as a result. As another example, a disk-shaped or plate-shaped portion may be stamped. As a result, a positioning face with high dimensional stability is advantageously produced. Finally, the guide length of the collar may be further extended by a stamped portion in the drawing direction.

Some example methods may further comprise:

preforming a region of the workpiece in order to form a material reserve and/or a defined geometry for drawing the workpiece.

As a result of the preforming of a region of the workpiece, a material reserve can be formed for a subsequent drawing operation. As a result, in combination with the steps of drawing, punching, expanding, ironing, and/or further expanding, the collar length can be increased particularly effectively even in the case of high-strength materials. In this example method, more material can be drawn into the wall region. As a result, high quality demands for the collar can be satisfied. Likewise, the base region does not thin out excessively, with the result being that base cracks can be avoided even with greater collar lengths. As a result of the preforming to form a material reserve, modifications or adaptations, which can serve specifically to support the drawing operation, can be carried out on the workpiece. For example, additional material can be provided thereby and/or the flowing of the material into the drawn region can be made easier. For example, as a result of the preforming to form a material reserve, the material can be accumulated in the region of the material reserve, such that additional material is available for drawing. For example, a specific geometry of the workpiece can be provided in the region of the material reserve, this geometry favoring drawing. The material of the material reserve can flow in particular into the wall region and/or drawn base during drawing. In some examples, the material reserve may be used up after the drawing of the workpiece. In addition or alternatively, additionally defined geometries can be preformed or formed in the workpiece, said additionally defined geometries remaining in the workpiece after collar drawing has been completed. This may be understood to be, for example, a step geometry with a defined shape. For instance, regional lowering of the flange region may be achieved as a result. For example, a disk-shaped or plate-shaped portion may be preformed or stamped. A positioning face with high dimensional stability may be advantageously produced by the latter.

As a result of the preforming, one or more corrugations can be formed, for instance. For example, one or more encircling, in particular, concentric corrugations may be formed around the region to be drawn. In some examples, at least two concentric corrugations encircling the region to be drawn may be provided. Such preforming is not only particularly quick to carry out and results in fast cycle times, but also allows the formation of the required material reserve in a satisfactory manner. For example, corrugations may no longer be present at the end of drawing. Thus, in order to form the region of the material reserve, in some examples preforming may only be carried out as much as necessary in order to avoid excessive material stresses. However, other alternative configurations of the region of the material reserve are also conceivable in principle, for example, by way of a material thickening.

In some example methods, the region of the material reserve may be located outside and/or inside the region to be drawn. The region to be drawn may be understood here as meaning in particular the contact region of a drawing punch base with the workpiece. For example, the region of the material reserve may be provided in the flange region. As a result, the region of the material reserve can be provided at a defined distance from the drawing region and can provide material reliably during drawing. Alternatively or in addition, the region of the material reserve can also be formed in the region to be drawn, that is, in the region of the drawn base, with the result that thinning out in the region of the drawn base can be counteracted.

For example, the corrugations may be provided in or counter to the drawing direction. For example, some of the corrugations may be provided counter to the drawing direction, for instance, one or more corrugations outside the region to be drawn, and some of the corrugations may be provided in the drawing direction, for instance, one or more corrugations within the region to be drawn.

The preforming of the region to form the material reserve can take place depending on the properties of the workpiece and/or the collar shape to be achieved. Since the region of the material reserve may be cut to size depending on the collar shape, reliable production of the collar can be achieved with little effort. For example, the geometry of the region of the material reserve may be determined depending on the material and/or on the workpiece thickness. If, for example, one or more corrugations is provided in the region of the material reserve, the height, the width, and/or the shape of the corrugations can be made dependent on the material and/or on the workpiece thickness, for instance. Likewise, the spacing of the corrugations can be made dependent on the material properties. For example, the height of the corrugations may be selected such that the stretching capacity of the material is not exceeded. Likewise, a workpiece length, additionally produced by the preforming, in the region of the material reserve may be dimensioned such that the stretching capacity of the material is not exceeded.

The preforming of the region to form the material reserve can at least regionally include prestretching up to the elastic limit of the material at most. As a result of prestretching of the material and the resultant additional length, the flow of material out of the material reserve into the wall region can be improved and the material reserve can be provided easily and efficiently. In some examples, the stretching capacity of the material is not exceeded in the process, since otherwise the reliability and quality would be impaired.

A controlled force may be applied at least at times and at least in regions to the workpiece in the region of the material reserve during drawing, for example, by way of a holding-down means in the drawing direction. As a result of the force application, the material reserve can additionally be pushed into the region to be drawn, and this can further improve the material flow into the wall region.

In some examples, a generic device for carrying out various methods according to the present disclosure may comprise structures or means for:

- drawing a workpiece such that the drawn workpiece has a flange region and a drawn region, adjoining the flange region, having a wall region and having a drawn base adjoining the wall region, and the wall region forms a part of the collar;
- punching the drawn base such that a drawn-base subregion adjoining the wall region is produced;
- expanding the drawn-base subregion such that the expanded drawn-base subregion forms a part of the collar; and
- at least regionally ironing and/or expanding the collar.

As explained above, as a result of a combination of the wall region and the widened drawn-base subregion, longer and precise collars can be formed, while the device can be realized easily in the context of press-supported devices. As also explained above, as a result of at least regional ironing and/or expanding of the collar, a homogeneous wall thickness of the collar can be achieved. In turn, strain hardening of the material of the collar can be achieved at the same time, which results in an overall greater loadability of the collar. Likewise, as a result of the ironing and/or expanding, further material can flow or be drawn out of the flange region into the wall region, and this can result in a further increased collar length.

In some examples, the means for drawing comprises a drawing punch. The means for punching can comprise, for instance, a cutting punch. The means for expanding can comprise, for instance, an expanding punch. The means for ironing can comprise, for example, an ironing punch. The means for further expanding can comprise a further expanding punch. The means for drawing, punching, expanding, ironing, and/or further expanding can be formed separately or be provided in a manner (at least partially) integrated into one another or combined with one another. For example, a combined punch can be provided that is configured for drawing, punching, expanding, ironing, and/or further expanding.

In some examples, the device may also have means for securing the workpiece. The means for securing the workpiece can be configured such that the workpiece is secured with its flange region in the device, in particular during the drawing, punching, expanding, ironing, and/or further expanding. The means for securing can be realized, for instance, by a pressure-controlled holding-down means.

According to some example configurations of the device, the means for drawing the workpiece comprise a drawing punch, wherein the drawing punch has an ironing shoulder, a protrusion, for at least regionally ironing and/or expanding the collar. As a result, the production of the collar can be realized with short cycle times and without substantial modification of existing press-supported devices. The ironing and/or expanding can take place specifically inline with the drawing. In particular, particularly simple integration of the means for ironing and/or expanding into the drawing punch is achieved. In one example, the ironing shoulder may be provided as a rounded protrusion. For example, the drawing punch transitions from a first (smaller) pre-expansion width to a second (larger) final expansion width, which is achieved on the collar by the ironing.

In some cases, the means for punching may have a rounded cutting edge arranged on the drawing punch base of the drawing punch, and a punching die that is arranged opposite the drawing punch and is adapted to the cutting edge. Thus, a combined punch for drawing/cutting/expanding/ironing may be provided. The cutting edge protrudes from the drawing punch base, for example, in the drawing direction and at a distance from the drawing punch edge. The drawing punch may also serve to widen the drawn-base subregion. As a result, the production of the collar can be realized with short cycle times and without substantial modification of existing press-supported devices. The drawing, punching, expanding, and ironing may be realizable, for example, merely by a movement of the drawing punch in the drawing direction.

In principle, the drawing stamp can have different cross-sectional shapes as seen in the drawing direction, for example, a round, oval, or polygonal cross section. Particularly good results with regard to the collar quality may be achieved, however, when the drawing punch has a substantially round cross section or is configured in a rotationally symmetrical manner. For example, the rounded cutting edge may be arranged concentrically on the drawing punch base. For example, a cup-like drawn region may initially be produced by means of the drawing and subsequently a hub-like collar can be produced by the punching. The drawn base can be shaped in principle parallel or at an angle to the flange region of the workpiece. In addition, the boundary line of the drawn base can be shaped in a circular form, an undulating form, or some other form.

If the drawing punch base, apart from the cutting edge, is formed in a substantially flat manner and extends transversely to the drawing direction, undesired excessive pre-stretching of the drawn base may be avoided and more material can flow out of the flange region into the wall region.

For example, a circular, and in some cases rounded cutting edge and a sharp-edged punching die adapted thereto can be provided, such that a circular opening can be punched into the drawn base. However, other geometric cross sections suitable for punching are also usable here, for instance, oval or polygonal cross sections. In this case, the cross-sectional shapes used during drawing and punching can substantially correspond to one another, apart from an offset, for instance, or different shapes can be used.

As disclosed above, the cutting edge may in some cases be rounded. As a result, inter alia, the drawn part base may advantageously not be damaged by the cutting edge during drawing and, for example, no notching arises or no early, partial punching of the workpiece takes place. Rather, the material can initially slide over the cutting edge. In conjunction with the punching die, the movement of which counter to the drawing direction is inhibited, punching of the drawn base may then take place at a defined time. Thus, the quality of the collar wall and the possible drawing depth may be increased.

The fact that the cutting edge is rounded in some examples means that the radius of the cutting edge may be greater than 0.15 mm, and in some cases greater than 0.25 mm, preferably up to 1 mm. For example, the radius of the cutting edge may be between 0.3 and 0.8 mm. For example, the radius of the cutting edge may be between 0.5 and 1.5 mm.

According to one example, the device has means for at least regionally upsetting the collar, such as an upsetting shoulder. For example, the means for drawing the workpiece may comprise a die, wherein the die has the upsetting shoulder for at least regionally upsetting the collar. As explained above, as a result of the upsetting of the collar, local length differences of the collar can be reduced or avoided and further strain hardening can be introduced into the collar. By way of an upsetting shoulder integrated into a die, the production the upsetting of the collar can be realized with short cycle times and without substantial modification of existing press-supported devices.

The die can comprise, for example, a neck forming contour such that the workpiece can be subjected to a drawing operation by means of a relative movement of the drawing punch and die, such that the collar can be formed by the punch along the neck forming contour. The upsetting shoulder may be provided, for example, as a protrusion on the neck forming contour. The upsetting shoulder may be, for example, positioned such that the collar end sits on the upsetting shoulder after the expanding of the drawn-base subregion. Advantageously, the die and the punching die may in this case be configured such that the punching die can slide past the upsetting shoulder.

Further, the die may include a stop for preventing expansion of the workpiece in the flange region. If a material reserve is provided in the workpiece, the stop can advantageously prevent the workpiece expanding radially outwards and/or at least regionally thickening as a result of the material from the material reserve. Thus, as much material from the material reserve as possible can support the drawing operation.

In some examples, the means for drawing the workpiece may comprise a drawing punch and/or a die, and the drawing punch and/or the die may have a forming shoulder for integrally forming a defined geometry, such as a stamped portion, in the flange region of the workpiece. The drawing radius can be reduced to a required minimum as a result, and precise positioning of the collar for further steps can be made easier. The integral forming of the defined geometry can thus likewise take place in a manner integrated with the formation of the collar. For example, the drawing punch may have a drawing-punch-side forming shoulder and the die may have a corresponding die-side forming shoulder.

Furthermore, in some examples, the device may comprise:

means for preforming a region of the workpiece so as to form a material reserve and/or a defined geometry for drawing the workpiece.

By way of the means for preforming, the collar length can be increased particularly effectively in combination with the means for drawing, punching, expanding, ironing, and/or further expanding with the device, even in the case of high-strength materials. In addition, high quality demands can be satisfied, as enough material can be drawn into the wall region and the base region thus does not thin out excessively.

The device may have means for the controlled application of force to the workpiece in the flange region at least at times and at least in regions during drawing. The means for the application of force can be realized, for example, by a holding-down means. As a result of the controlled application of force in the flange region, and in some instances in the region of the material reserve, the material can be additionally pushed into the region to be drawn from the region of the material reserve, this being able to improve the material flow.

In some examples, the device may comprise:

a first tool or a first tool portion, and a second tool or a second tool portion, wherein the first tool or the first tool portion has the means for preforming, and wherein the second tool or the second tool portion has the means for drawing the workpiece, the means for punching the drawn base, the means for expanding the drawn-base subregion and/or the means for at least regionally ironing and/or expanding the collar.

In this way, the preforming of a material reserve region can be integrated into existing methods without substantial modification of the remaining tools. In order to further shorten the cycle times, the first tool or the first tool portion can in some examples also be combined with other work steps. For instance, the drawing, the punching of the drawn base, the expanding of the drawn-base subregion, and the ironing and/or expanding of the collar take place in the second tool or tool portion. As a result, otherwise necessary transporting motions between individual tools can be reduced to a minimum.

The insertion of the workpiece into the first tool or the first tool portion may therefore take place first of all, wherein at least the preforming to form the material reserve takes place. The workpiece can then be removed and subsequently inserted into the second tool or the second tool portion. In this case, the workpiece may be positioned, for example, between a drawing punch and a die with a holding-down means. After the drawing, punching, expanding, ironing, and/or further expanding of the workpiece, the workpiece can be removed with a fully formed collar.

The device may additionally have an inhibiting element that serves for the defined application of force to the punching die at times in reaction to a force action on the part of the drawing punch in the drawing direction. As a result of the inhibiting element, the drawn base can be punched at a defined time. In addition, since the application of force takes place only at times, a movement of the punching die in the drawing direction can be allowed such that expanding is allowed after punching. For example, the device may be set up such that a defined inhibiting force of the punching die exceeds the cutting force required for punching the drawn base part, in order to allow punching. The inhibiting force can be exerted for example by the inhibiting element. For example, the inhibiting element may be configured as a push-in wedge that is movable transversely to the drawing direction and that inhibits movement of the punching die in the drawing direction. For example, the push-in wedge can enable the movement of the punching die in the drawing direction again, given sufficient application of force in the drawing direction, when the defined inhibiting force of the punching die exceeds the cutting force required for punching the drawn base part. For example, the push-in wedge may be spring-mounted. For example, the push-in wedge and the punching die may have sliding surfaces that are adapted to one another and that allow the punching die to slide on the pushing wedge and the push-in wedge to be displaced. For example, the punching die may likewise be spring-mounted in order to allow a further force counter to the drawing direction.

As those having ordinary skill in the art will appreciate, the preceding and following disclosure of example steps according to various example methods are intended also to disclose corresponding means for carrying out the method steps by way of example devices. Likewise, the disclosure of various example means for carrying out method steps is intended to disclose corresponding method steps.

Turning now to the figures, FIG. 1 shows a schematic view of an example first tool or tool portion 1 of a device before the formation of a material reserve. The tool or tool portion 1 is illustrated in a partial longitudinal section and may be constructed symmetrically about the axis A. The tool or tool portion 1 may be installed in a suitable press (not illustrated here) and may have, with an upper die 1*a* and a matching lower die 1*b*, means for preforming a region 4 of a workpiece or workpiece portion 2. The workpiece or workpiece portion 2 in the form of a plate or a metal sheet may be placed between the dies 1*a*, 1*b* with the press open. By way of the geometry of the pressing surfaces, a region 4 of the workpiece 2 can be formed by the tool 1, such that a material reserve for a subsequent drawing operation is formed in the region 4. To this end, for example, the upper die 1*a* may be moved toward the lower die 1*b* in the direction of the arrow 6 in order to close the tool 1.

Figure 2:
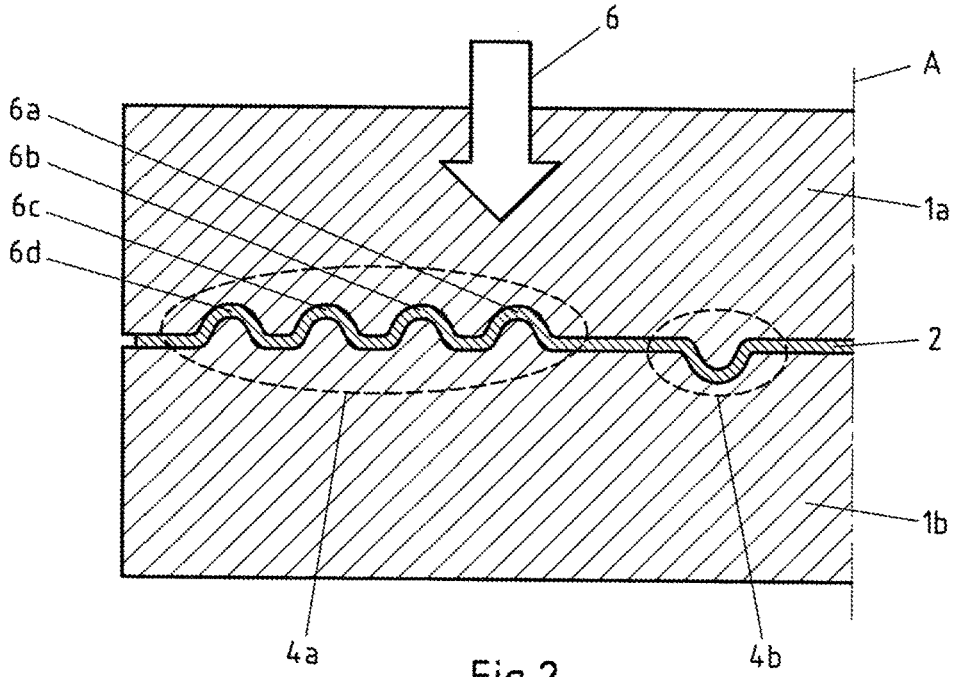
FIG. 2 is a schematic view of the first tool or tool portion from FIG. 1 after the formation of a material reserve.

FIG. 2 shows a schematic view of the first tool 1 from FIG. 1 after the formation of a material reserve in the regions 4*a* and 4*b* of the tool 2. As a result of the preforming of the region 4*a*, in the example illustrated, four encircling concentric corrugations 6*a*, 6*b*, 6*c*, 6*d* were formed outside the region to be drawn. As a result of the preforming of the region 4*b*, in the example illustrated, an encircling concentric corrugation 6*e* may additionally be formed within the region to be drawn and in the opposite direction to the corrugations outside the region to be drawn. The (pre-) forming with the tool 1 may effect prestretching of the material in the regions 4*a*, 4*b* and the adjoining regions, resulting in lengthening of the cross-sectional length in the regions 4*a*, 4*b* of the workpiece or workpiece portion 2. As a result, the regions 4*a*, 4*b* with the corrugations 6*a*, 6*b*, 6*c*, 6*d*, 6*e* can serve as a material reserve for a subsequent drawing operation.

Figure 11:
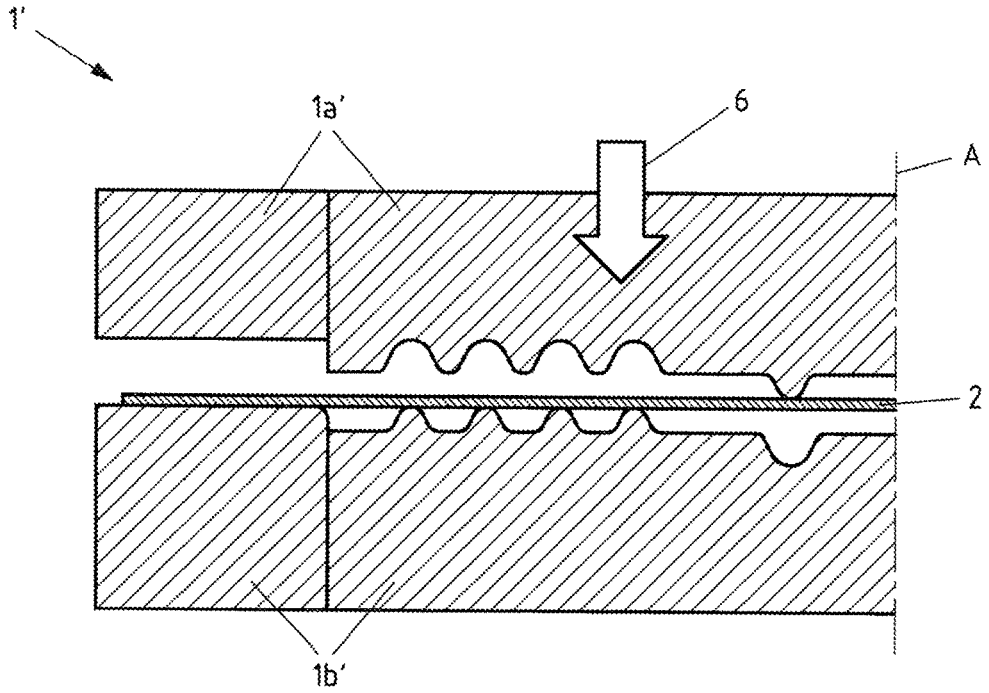
FIG. 11 is a schematic view of a second exemplary embodiment of a first tool or tool portion of a device before the formation of a material reserve and of a defined geometry.
Figure 12:
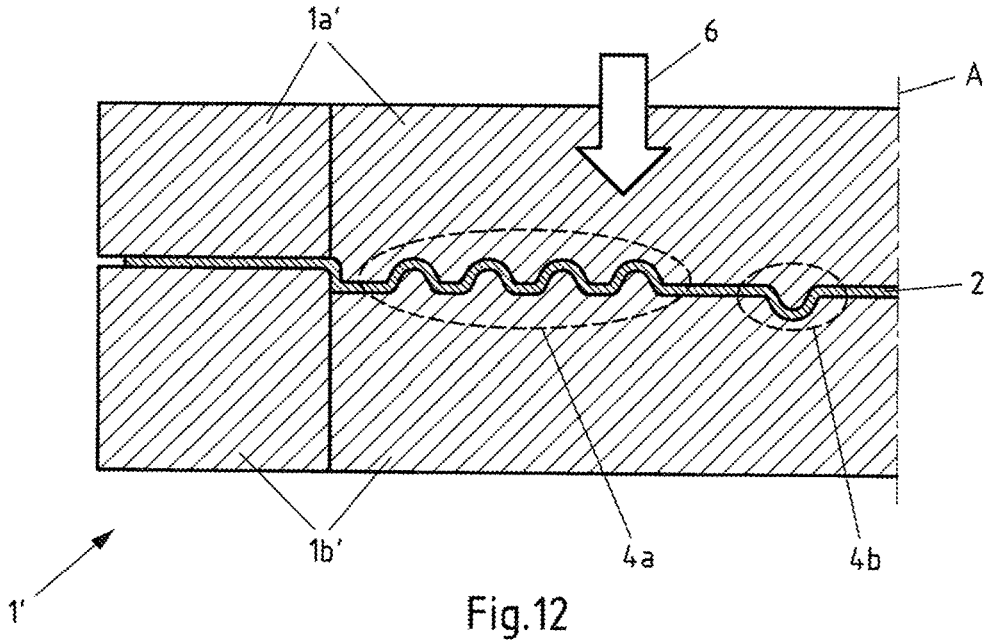
FIG. 12 is a schematic view of the first tool or tool portion from FIG. 11 after the formation of a material reserve and of a defined geometry.

Since the tool 1 can also be a tool portion of a more complex tool (not illustrated), it is possible for the tool 1 also to be able to execute further processing operations, for example, further forming processes, on the workpiece 2 during the closing of the press, as is illustrated, for example, in FIGS. 11 and 12. Compared with FIGS. 1 and 2, the first tool or the first tool portion 1' may be configured such that a defined geometry 58, for example, a step geometry with a defined shape, can additionally be preformed or formed in the workpiece 2. For example, a regionally small lowering and/or raising of the outer region of the flange region 20 may be achieved as a result. This prevents undesired material flow in the direction of the component edge. Furthermore, a positioning face with high dimensional stability may be produced on the inner region of the flange region 20, said positioning face remaining in the workpiece after completion of collar drawing (see FIG. 13).

Figure 3:
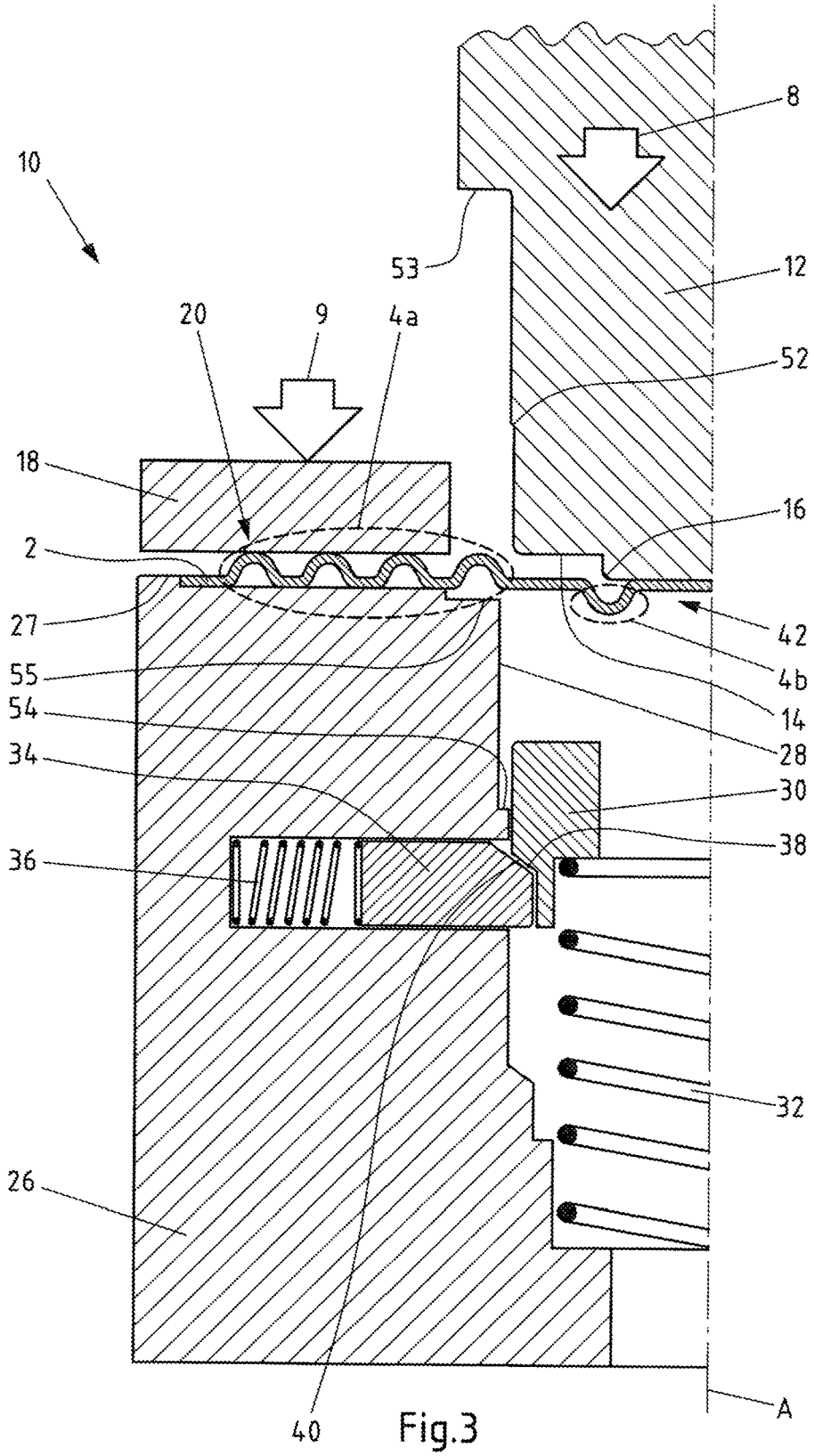
FIG. 3 is a schematic view of an exemplary embodiment of a second tool or tool portion of a device before drawing.

FIG. 3 shows a schematic view of an exemplary embodiment of a second tool or tool portion 10 of an exemplary embodiment of a device according to the disclosure before drawing. The tool 10 may likewise be constructed symmetrically about the axis A. It may have, with a drawing punch or drawing/cutting punch 12 that is movable in the drawing direction 8, means for drawing the workpiece 2. The drawing punch may have a rounded cutting edge 16 arranged on the drawing punch base 14. The cutting edge 16 may project out of the drawing punch base 14 in the drawing direction 8. This avoids the risk of premature damaging or punching of the workpiece 2.

The drawing punch 10 may also have an ironing shoulder in the form of a protrusion 52, which serves to iron the collar, and a drawing-punch-side forming shoulder 53 for integrally forming a defined geometry in the form of a stamped portion in the flange region 20 of the workpiece 2. This is explained below in connection with FIGS. 7-9.

The tool 10 may additionally have, with the holding-down means 18, means for securing the workpiece 2. As illustrated by the arrow 9, the holding-down means can apply a controlled force in the drawing direction 8 to the workpiece 2 in a flange region 20. As a result, the workpiece 2 can be secured and material can be fed from the region 4*a* of the material reserve. The region 4*b* of the material reserve may, by contrast, be arranged in the region to be drawn, in this case in the region of the cutting edge 16.

The tool 10 furthermore may have a die 26. The die 26 has a stop 27. The stop 27 prevents expansion of the workpiece 2 in the flange region 20, since the workpiece 2 cannot expand radially outwards even under application of force by the holding-down means 18 as a result of the material from the region 4*a* of the material reserve. The die 26 may have a neck forming contour 28 that is adapted to the drawing punch 12. A punching die 30 may be spring-mounted in the lower region of the die 26, said punching die 30 being adapted to the cutting edge 16 in order to allow the drawn base 42 to be punched. In addition, a spring element 32 may apply a force counter to the drawing direction 8 to the punching die 30. An inhibiting element in the form of a push-in wedge 34 may additionally be mounted in the die 26. The push-in wedge may support the punching die 30 such that the movement of the punching die 30 in the drawing direction 8 is initially inhibited. To this end, the push-in wedge 34 may push under the punching die 30 by way of a spring element 36. The punching die 30 and the push-in wedge 34 may include mutually adapted sliding faces 38, 40 that allow the punching die 30 to slide on the push-in wedge 34.

The die 26 may also have a step-like upsetting shoulder 54 for upsetting the collar. Moreover, the die 26 may have a die-side forming shoulder 55, matching the drawing-punch-side forming shoulder 53, for integrally forming a defined geometry in the form of a stamped portion in the flange region 20 of the workpiece 2. This is explained below in connection with FIGS. 7-9.

Figure 4:
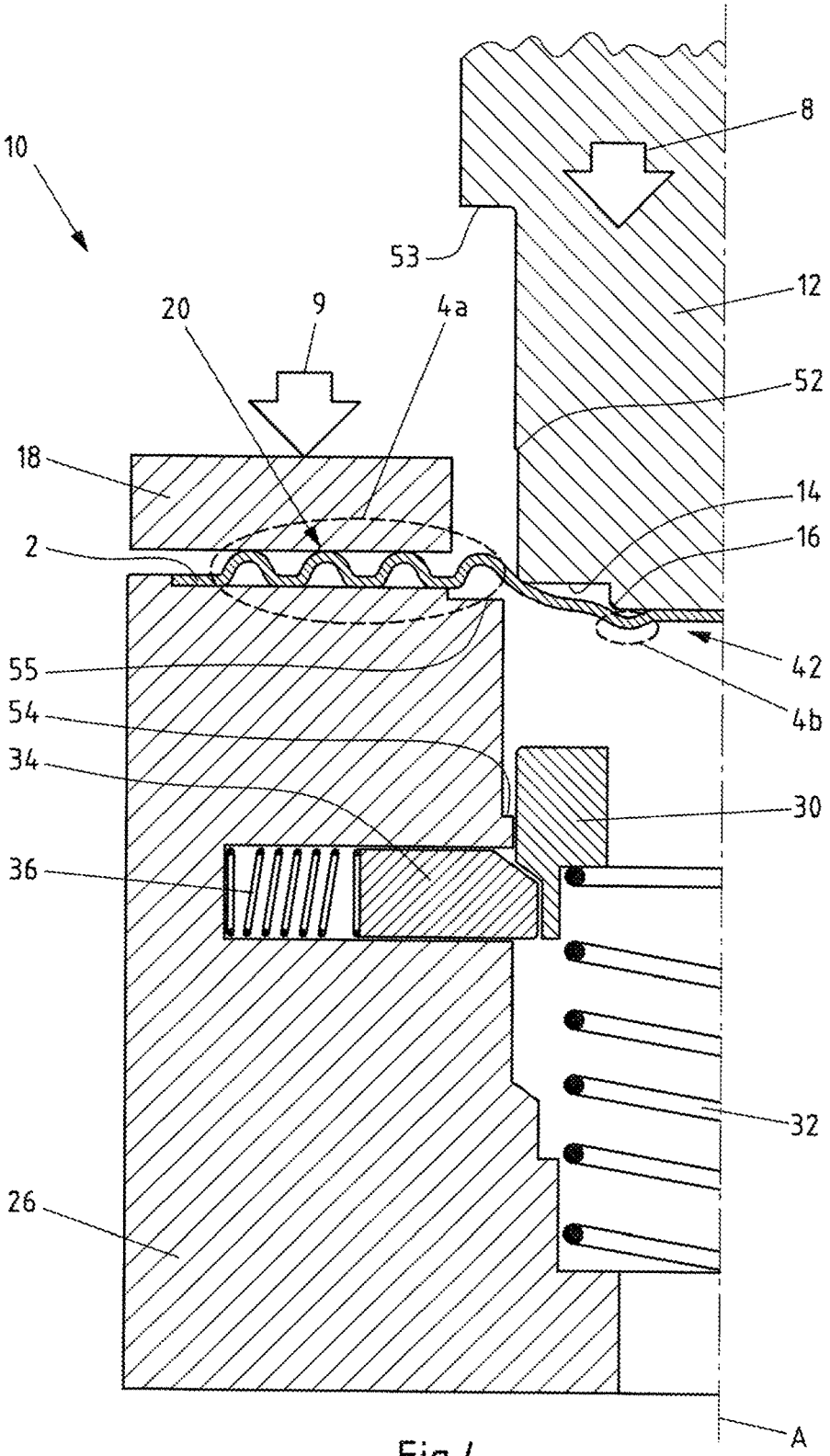
FIGS. 4-5 are schematic views of the second tool or tool portion from FIG. 3 during drawing.
Figure 5:
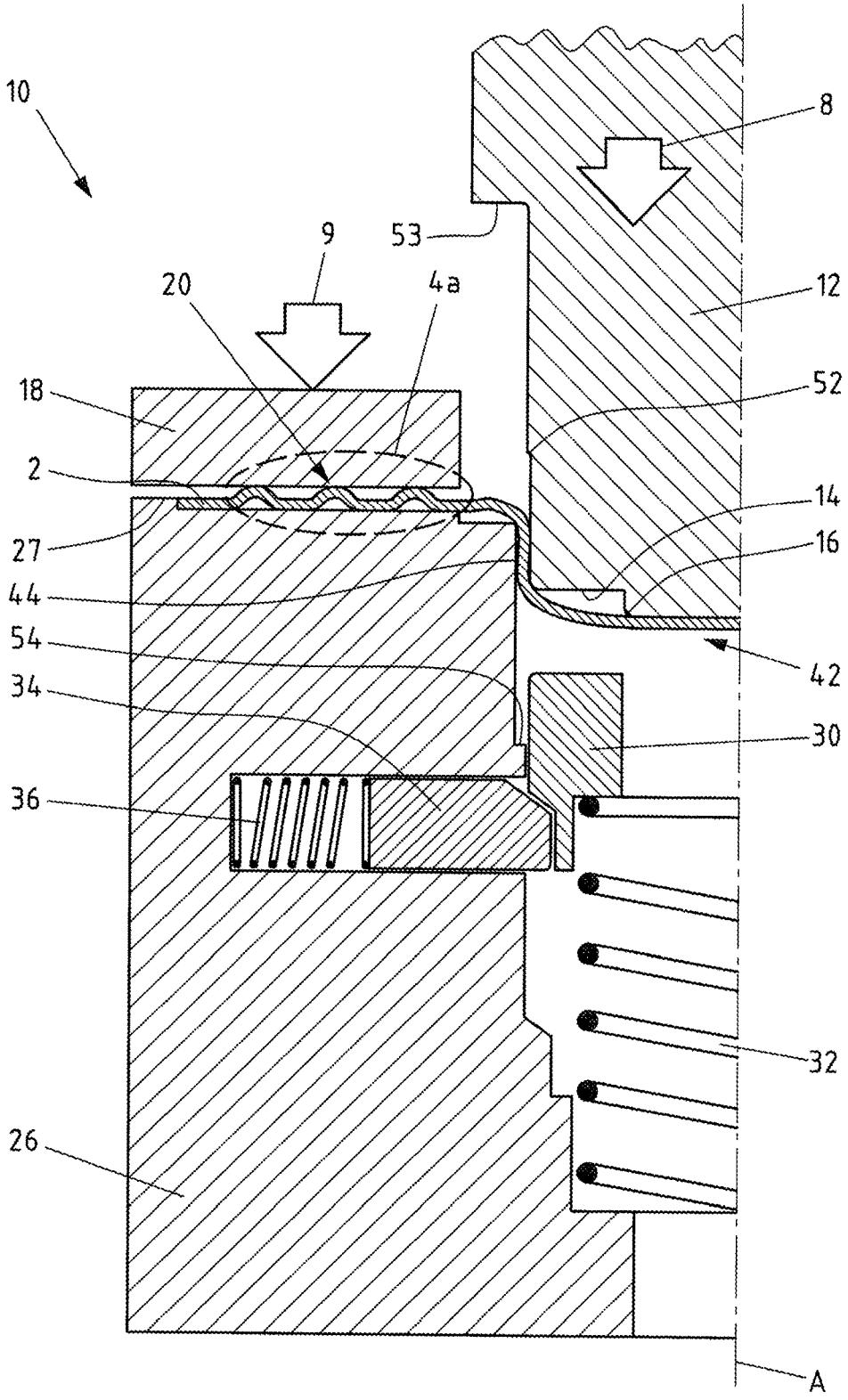

FIGS. 4 and 5 show a schematic view of the second tool 10 from FIG. 3 during drawing. The drawing punch 12 may be moved in the drawing direction 8 in this case. As a result, a drawn region having a wall region 44 adjoining the flange region 20 and having a drawn base 42 adjoining the wall region 44 may be formed in the workpiece 2. During drawing, first of all the material reserve in the region 4*b* may be planed (FIG. 4). Subsequently, material for the drawing operation may be provided by the region 4*a* and drawn into the wall region 44 (FIG. 5). At the same time, as a result of the application of force to the region 4*a* by the holding-down means 18, material of the material reserve may be fed into the wall region 44. As a result, the wall region 44 can be formed in a longer manner than with conventional methods, while the drawn base 42 does not substantially thin out. As can be seen in FIG. 5, the corrugations 6*a*, 6*b*, 6*c*, 6*d* are substantially planed during drawing.

Since a rounded cutting edge 16 may be provided, the drawn base 42 is not damaged or prematurely punched during drawing and thinning out of the drawn base 42 can be reduced or avoided by the substantially flat drawing punch base 14 extending transversely to the drawing direction 8.

During the ongoing drawing operation, either material may continue to be fetched into the wall region 44 from the flange region 20 and/or the wall region 44 may be ironed until the drawing punch 12 has reached the punching die 30. On account of the opposing force brought about by the push-in wedge 34, the punching die 30 cannot initially yield and the cutting edge 16 of the combined punch 12 for drawing/cutting/expanding/ironing may punch the drawn base 42, a cutting slug 46 being cut or punched out of the drawn base 42, said cutting slug 46 being able to fall out of the tool 10 through the punching die and not needing to be removed manually.

Figure 6:
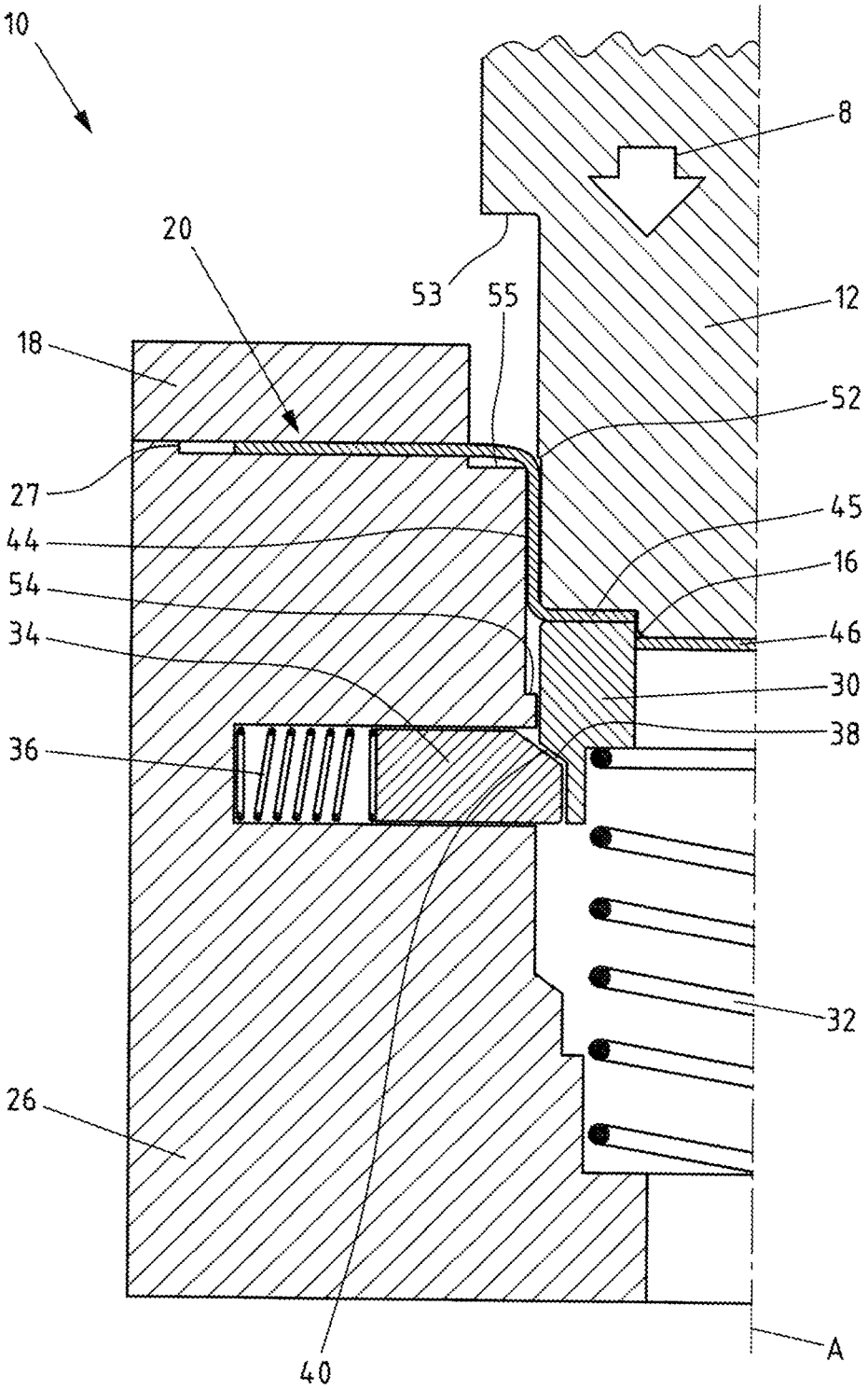
FIG. 6 is a schematic view of the second tool or tool portion from FIG. 3 after punching.

FIG. 6 shows in this regard a schematic view of the second tool or tool portion 10 from FIG. 3 after punching. A drawn-base subregion 45 now adjoins the wall region 44.

The ironing shoulder 52 may be located at this time just before engagement with the wall region 44. At the end of the punching shown in FIG. 6, the rounded ironing shoulder 52 may then engage with the wall region 44. If necessary, engagement can occur previously, or not occur until later. The ironing shoulder 52 ensures, with make-up of material from the flange region 20, that, with increasing lowering of the drawing punch 12 in the punching direction 8, the collar is ironed to the desired wall thickness dimension.

The opposing pressure of the punching die 30 on the drawing punch 12 may, however, be limited to the required cutting force for punching the drawn base part by the provision of the sliding surfaces 38, 40 on the punching die 30 and the push-in wedge 34 and by the spring-mounting of the push-in wedge 34. If the force limit is exceeded, the push-in wedge 34 may yield outward transversely to the drawing direction 8. The punching die 30 may be displaced further downward in the drawing direction 18 by the drawing punch 12 and the drawing punch 12 can, simultaneously with the incipient ironing, carry out expanding of the drawn-base subregion 45 by continuing to move in the drawing direction 8.

Figure 7:
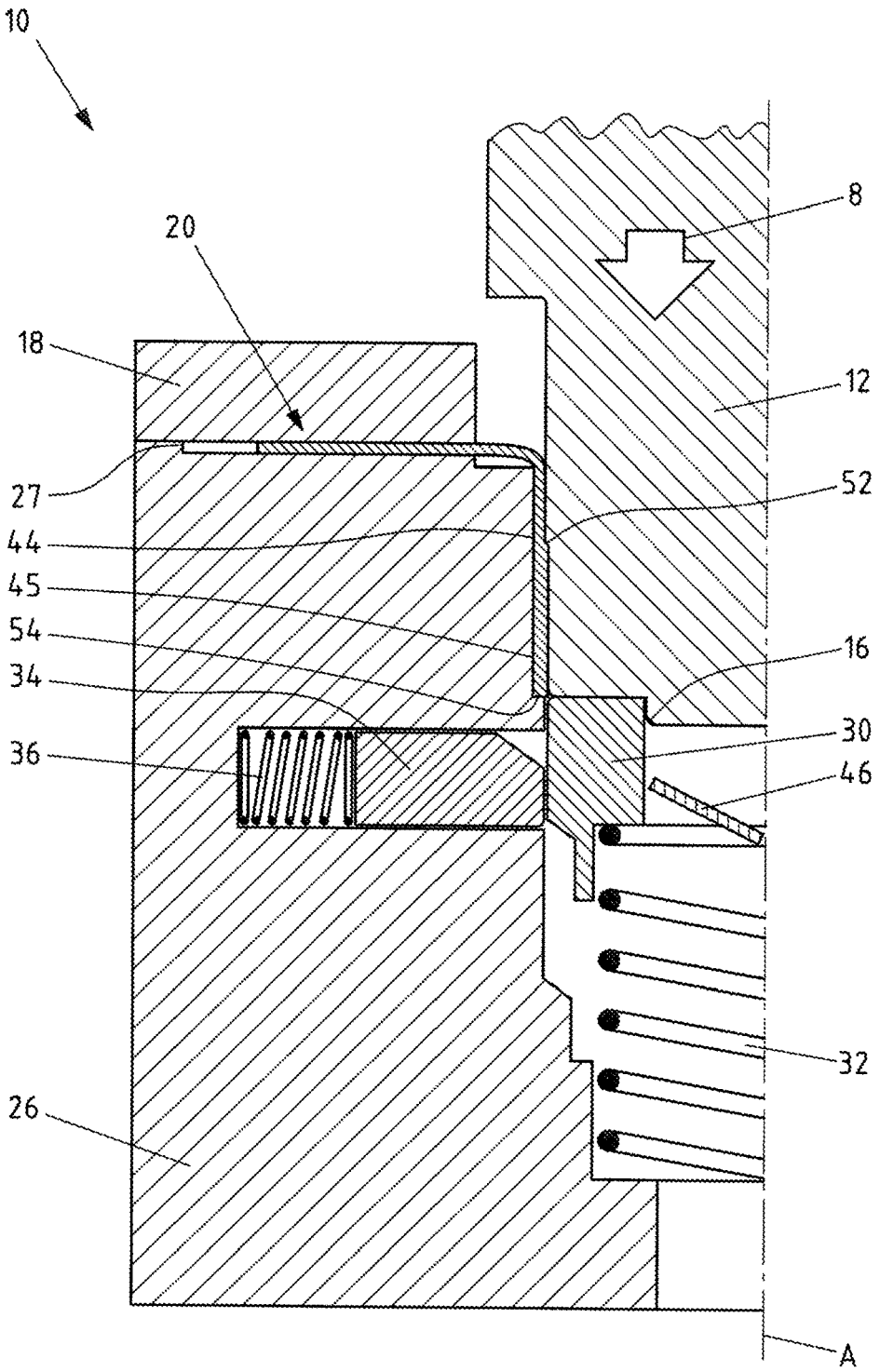
FIG. 7 is a schematic view of the second tool or tool portion from FIG. 3 after expanding.

FIG. 7 shows a schematic view of the second tool or tool portion 10 from FIG. 3 after the expanding of the drawn-base subregion 45 and after the ironing of the wall region 44 with the ironing shoulder 52 has started. Since the collar may comprise length sections of the wall region 44 and of the widened drawn-base subregion 45, a long collar can be formed without material failure occurring in the region 4*a*, 4*b* of the material reserve and of the rounded cutting edge 16.

As can also be seen in FIG. 7, the upsetting shoulder 54 may be positioned such that, after expansion of the drawn-base subregion 45 has been completed, the collar end sits on the upsetting shoulder 54.

Figure 8:
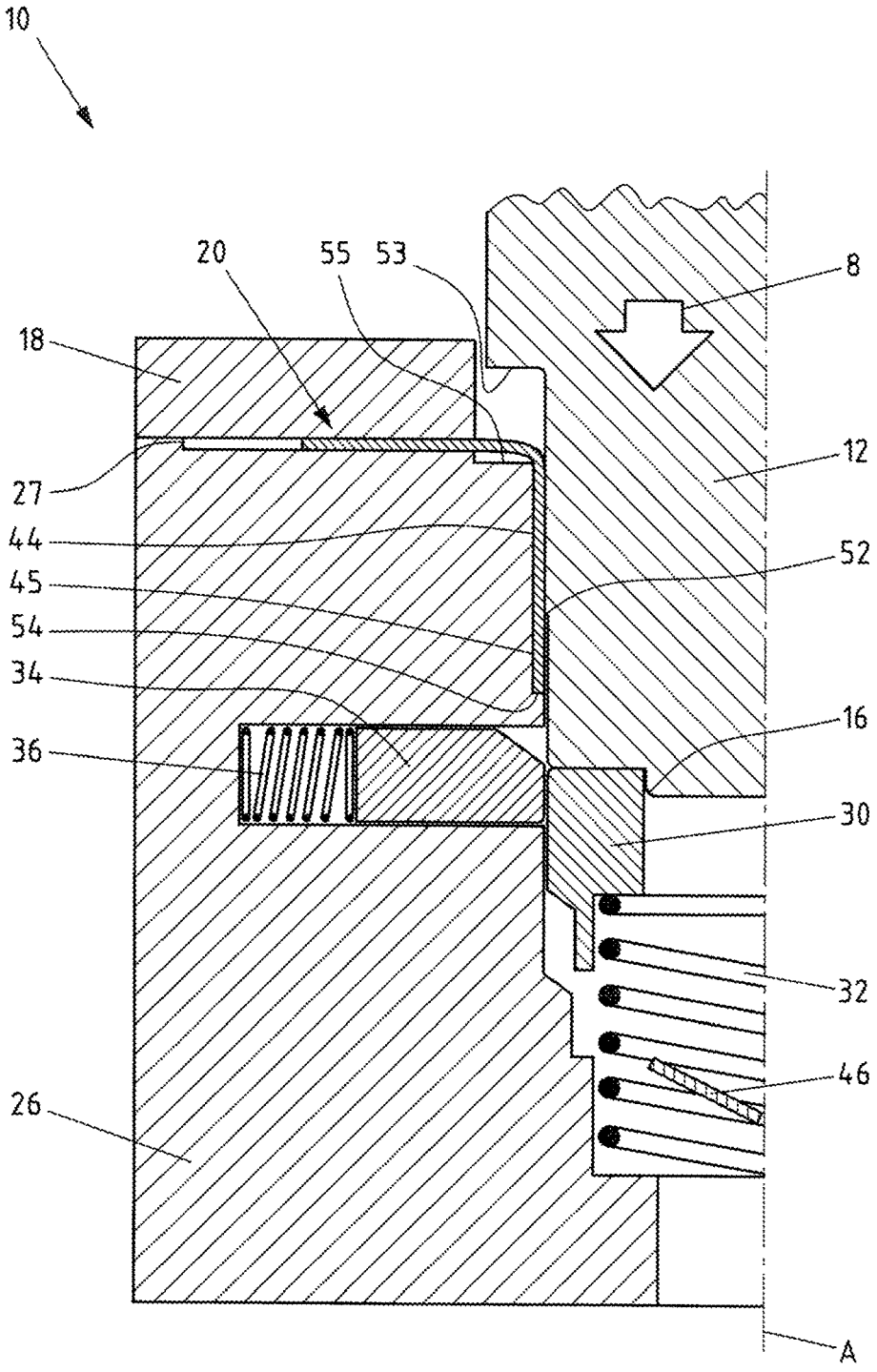
FIG. 8 is a schematic view of the second tool or tool portion from FIG. 3 during the further ironing of the collar.

FIG. 8 shows a schematic view of the second tool or tool portion 10 from FIG. 3 during the further ironing of the collar, with the drawing punch 12 being moved in the drawing direction 8. In this case, the collar, that is to say the wall region 44 and the expanded drawn-base subregion 45, may be ironed from a pre-expansion width to the final expansion width by the ironing shoulder 52. At the same time, the collar may be upset against the upsetting shoulder 54.

Figure 9:
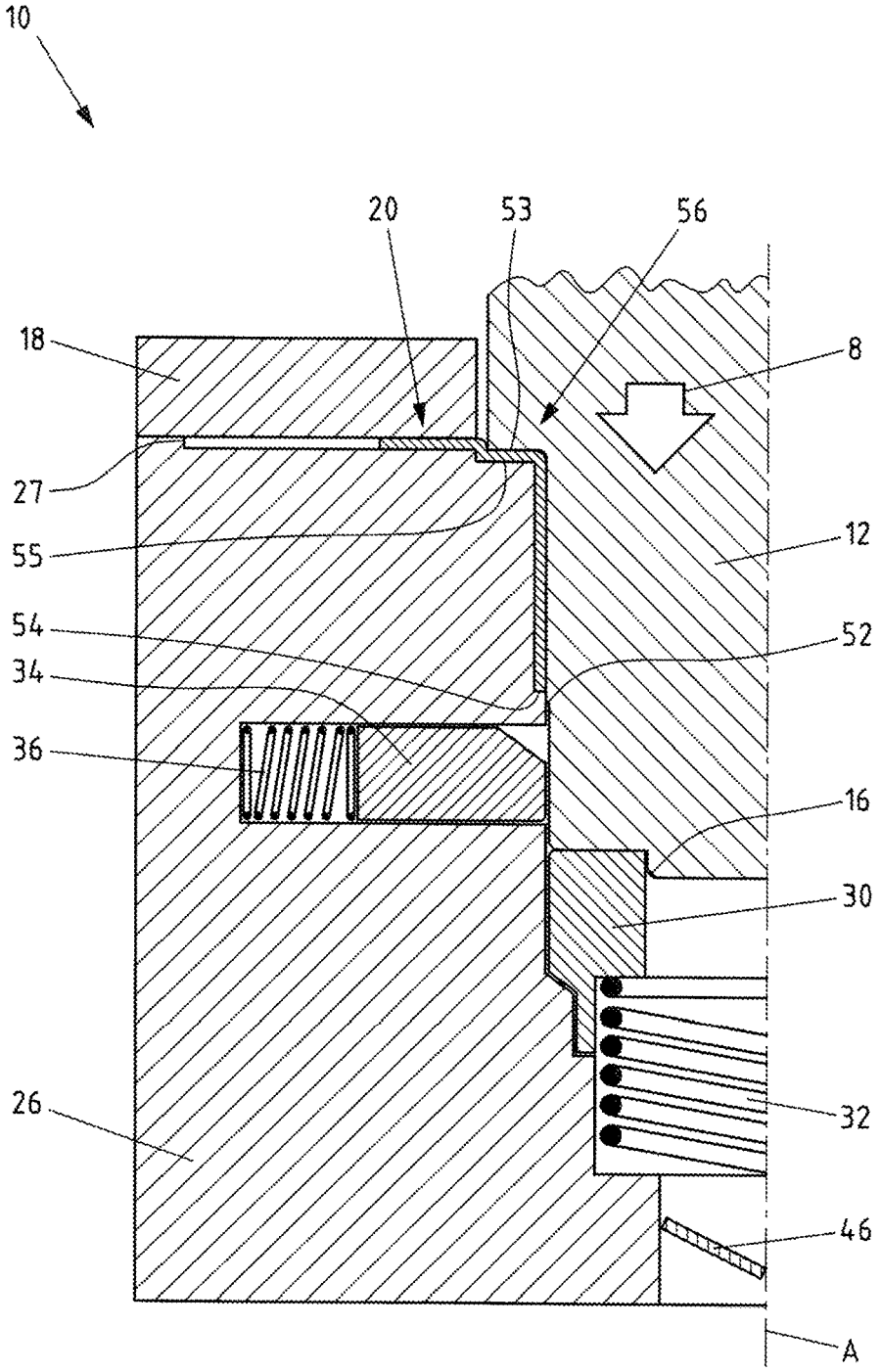
FIG. 9 is a schematic view of the second tool or tool portion from FIG. 3 after the ironing of the collar.

FIG. 9 shows a schematic view of the second tool or tool portion 10 from FIG. 3 after the ironing of the collar. The drawing punch 12 has been lowered into its end position. In this example, the entire collar was ironed to a uniform wall thickness, at the same time strain hardened and upset to the desired length dimension against the upsetting shoulder 54.

As can likewise be seen in FIG. 9, the drawing-punch-side integral-forming shoulder 53 of the drawing punch 12 may come into contact with the flange region 20 of the workpiece 2 and push the latter downward into the die-side integral-forming shoulder 55. In this example, on one side a small flange radius and on the other side a defined stamped portion 56 with an exact face, which can be used for positioning, may be formed in the flange region 20.

Figure 10:
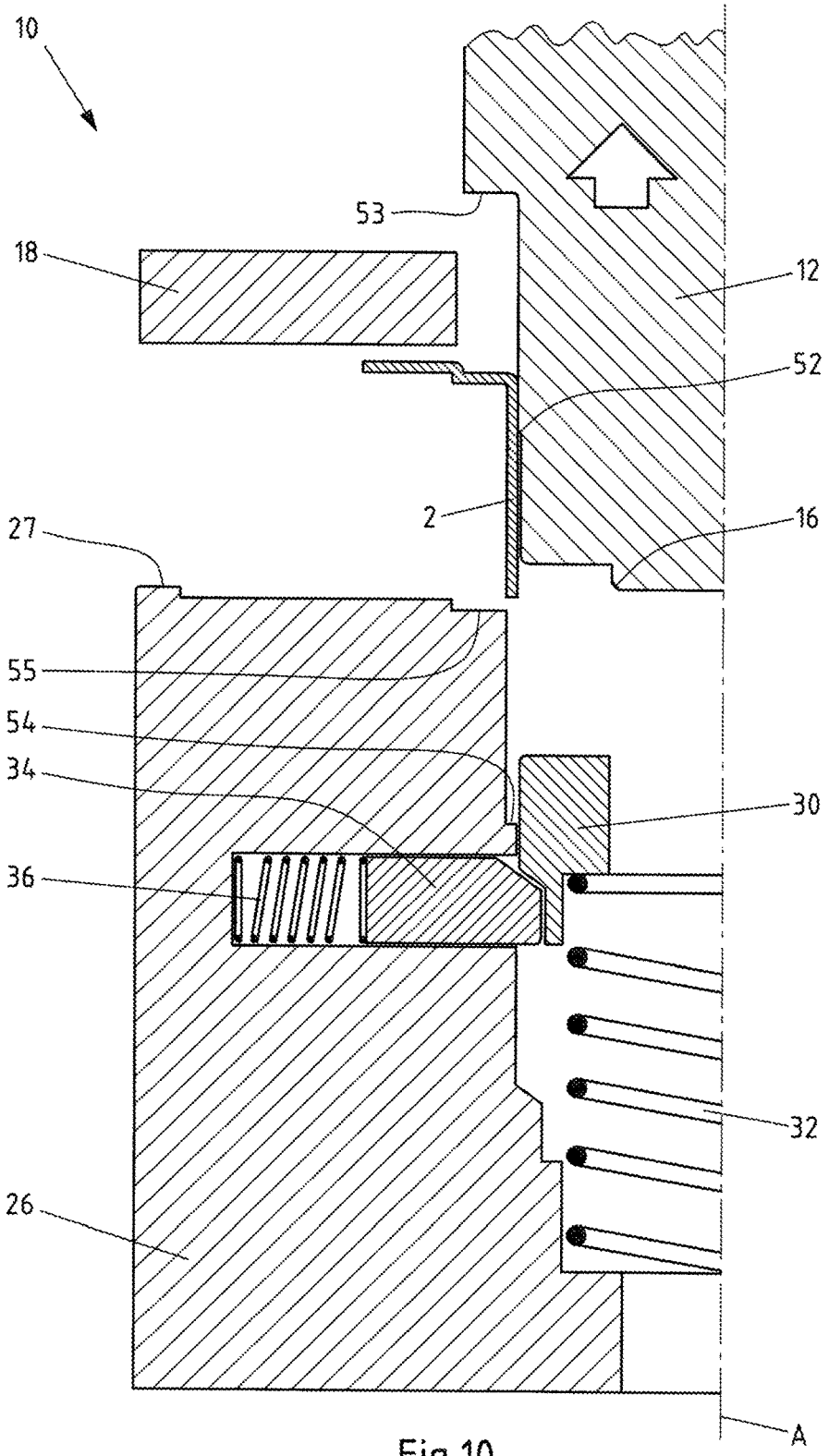
FIG. 10 is a schematic view of the second tool or tool portion from FIG. 3 after ejection.

As a result, collar formation may be concluded. By raising the drawing punch 12 and the holding-down means 18, the punching die 30 can travel back counter to the drawing direction 8 into the starting position, wherein the workpiece 2 is ejected. FIG. 10 shows a schematic view of the second tool or tool portion 10 from FIG. 3 after ejection.

Figure 13:
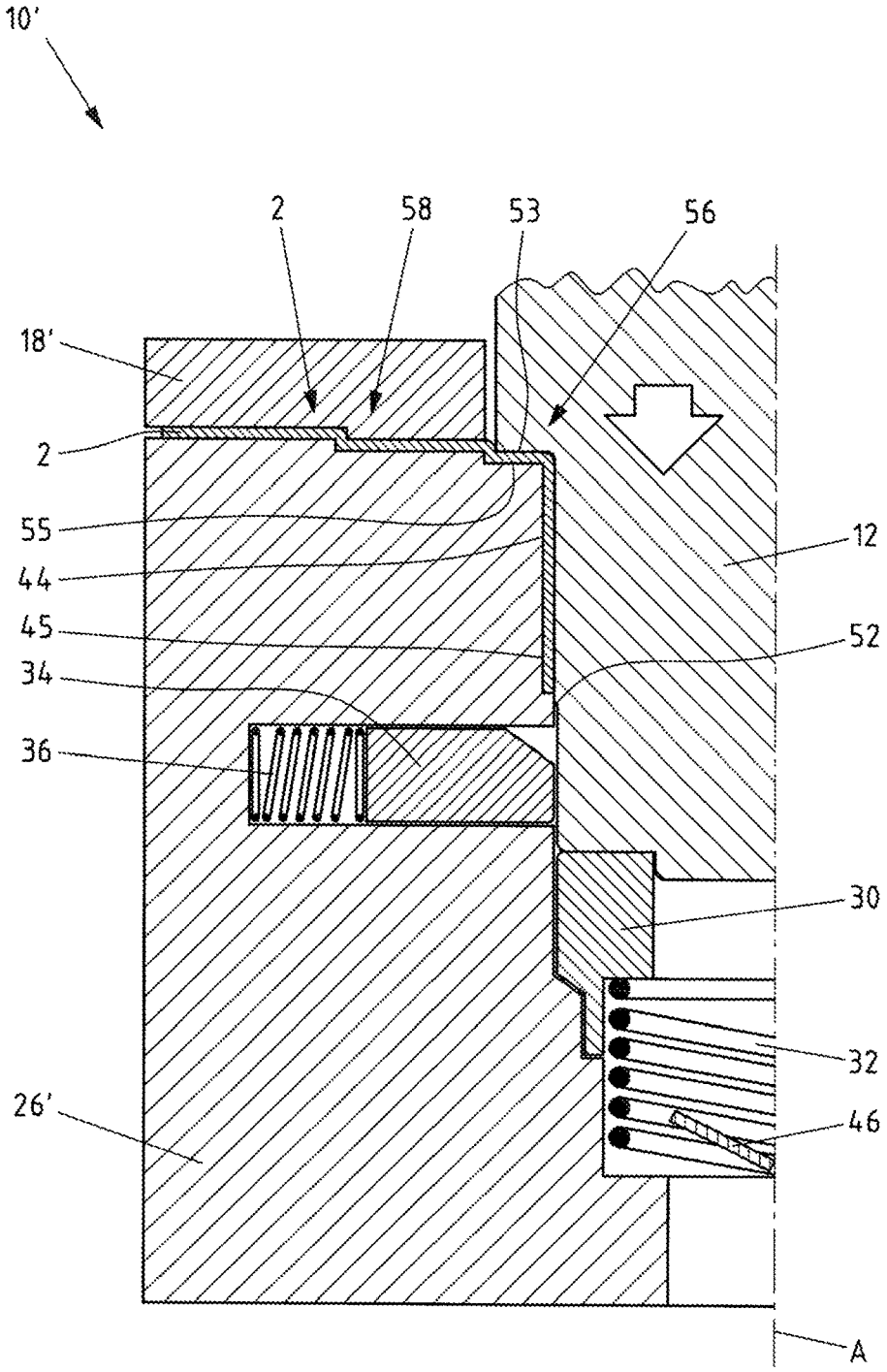
FIG. 13 is a schematic view of a second exemplary embodiment of a second tool or tool portion of a device after completion of forming.

FIG. 13 shows a schematic view of another example of a second tool or tool portion 10' of a device after completion of forming. The state of the second tool or tool portion 10' may thus correspond to the state of the tool or tool portion 10 as shown in FIG. 9. In contrast to the second tool or tool portion 10, the second tool or second tool portion 10' may have a modified die 26' and a modified holding-down means 18'. The die 26' and the holding-down means 18' may have a form adapted to the geometry 58, defined in FIG. 12, of the workpiece 2. As a result of the stepped geometry 58, undesired material flow in the direction of the edge of the workpiece 2 may be prevented. Furthermore, a positioning face with high dimensional stability may be produced in the inner region of the flange region 2, for example, said positioning face remaining in the workpiece 2 after collar drawing has been completed. Otherwise, the components and functioning of the embodiment, shown in FIG. 13, of the second tool or tool portion 10' correspond to those already described in conjunction with FIGS. 3-10, and so reference is made thereto in this respect.

What is claimed is:

1. A method for producing a collar on a workpiece, the method comprising:

drawing the workpiece such that the drawn workpiece has a flange region and a drawn region that adjoins the flange region, the drawn region including a wall region and a drawn base that adjoins the wall region, wherein the wall region forms a part of the collar;

punching the drawn base such that a drawn-base subregion adjoins the wall region;

expanding the drawn-base subregion such that the expanded drawn-base subregion forms a part of the collar;

one or more of at least partially ironing or at least partially further expanding or at least partially ironing and further expanding the collar; and at least partially upsetting the collar.

2. The method of claim 1 wherein a substantial portion of the collar is ironed, further expanded, or ironed and further expanded.

3. The method of claim 1 wherein the ironing, further expanding, or ironing and further expanding of the collar begins before the punching of the drawn base.

4. The method of claim 1 wherein the ironing, further expanding, or ironing and further expanding of the collar begins at the same time as or after the punching of the drawn base.

5. The method of claim 1 wherein the collar is ironed, further expanded, or ironed and further expanded to a substantially homogeneous wall thickness of the collar, wherein an ironed wall thickness corresponds at least to a smallest wall thickness prior to ironing of a region of the collar to be ironed.

6. The method of claim 1 wherein the at least partially upsetting the collar occurs after expanding the drawn-base subregion.

7. The method of claim 1 further comprising integrally forming a stamped portion in an inner region of the flange region of the workpiece at an end of the ironing, further expanding, or ironing and further expanding.

8. The method of claim 1 further comprising preforming a region of the workpiece to form at least one of a material reserve or a defined geometry for drawing the workpiece.

9. The method of claim 8 wherein the material reserve is located outside the region to be drawn.

10. The method of claim 8 wherein the material reserve is located inside the region to be drawn.

* * * * *